US005080083A

United States Patent [19]

Sato et al.

[11] Patent Number: 5,080,083

[45] Date of Patent: Jan. 14, 1992

[54] DISCHARGE DEVICE AND IGNITION SYSTEM WITH SERIES GAP USING DISCHARGE DEVICE

[75] Inventors: Takashi Sato; Tetsuya Mitani; Mikio Hanzawa, all of Susono, Japan

[73] Assignee: Yazaki Corporation, Tokyo, Japan

[21] Appl. No.: 548,533

[22] Filed: Jul. 5, 1990

[30] Foreign Application Priority Data

Jul. 12, 1989 [JP] Japan ..... 1-178074
Oct. 17, 1989 [JP] Japan ..... 1-268054

[51] Int. Cl.[5] ..... F02P 3/02

[52] U.S. Cl. ..... 123/627; 313/124; 313/141; 123/169 G; 123/169 EL; 123/169 PA; 445/7

[58] Field of Search ..... 123/627, 143 R, 146.5 R, 123/169 R, 169 EL, 169 EB, 169 G, 169 PA, 169 PH, 266, 268; 313/120, 49, 51, 243, 141; 445/7, 29

[56] References Cited

U.S. PATENT DOCUMENTS

| | | | |
|---|---|---|---|
| 1,169,744 | 1/1916 | Gillet | 123/627 |
| 1,316,560 | 9/1919 | Conrad | 123/627 |
| 1,406,858 | 2/1922 | Henricks | 123/627 |
| 1,441,212 | 1/1923 | Cardwell | 123/627 |
| 1,442,947 | 1/1923 | House | 123/627 |
| 1,554,252 | 9/1925 | Smith | 123/627 |
| 1,623,982 | 4/1927 | Smith | 123/627 |
| 1,909,255 | 5/1933 | Doerrhoefer | 123/627 |
| 2,208,030 | 7/1940 | Holmes | 123/169 G |
| 3,613,653 | 10/1971 | Irvin, Jr. | 123/627 |
| 3,995,183 | 11/1976 | Lechner et al. | 313/124 |
| 4,351,308 | 9/1982 | Halilovic et al. | 123/627 |
| 4,475,055 | 10/1984 | Boettcher | 313/54 |
| 5,014,656 | 5/1991 | Laptich et al. | 123/169 PA |

FOREIGN PATENT DOCUMENTS

| | | | |
|---|---|---|---|
| 129599 | 9/1945 | Australia | 123/627 |
| 134329 | 2/1947 | Australia | 123/627 |
| 133051 | 6/1949 | Australia | 123/627 |
| 663528 | 12/1951 | Australia | 123/627 |
| 0378963 | 1/1989 | European Pat. Off. . | |
| 744101 | 1/1944 | Fed. Rep. of Germany . | |
| 6607772 | 4/1971 | Fed. Rep. of Germany . | |
| 1136437 | 12/1956 | France | 123/627 |
| 2475797 | 2/1981 | France . | |
| 51-32180 | 9/1976 | Japan . | |
| 1400446 | 7/1975 | United Kingdom | 123/627 |
| 2124426 | 7/1983 | United Kingdom . | |

*Primary Examiner*—Raymond A. Nelli
*Attorney, Agent, or Firm*—Armstrong, Nikaido, Marmelstein, Kubovcik & Murray

[57] ABSTRACT

A discharge device of the present invention including a pair of electrodes opposingly disposed in a sealed tube is characterized by the provision of a conductive member surrounding one of the electrodes in the sealed tube. An ignition system with a series gap has a built-in discharge device provided with a series gap, with one end connected to the center electrode side of the spark plug and with the other end connected to the high-tension cable side extending from the high-voltage distribution side. In this ignition system, a discharge device has a conductive member which surrounds one of the electrodes of the sealed tube, and one of the electrodes enclosed with the conductive member of this discharge device works as a cathode. Furthermore, in this ignition system with a series gap which includes a discharge tube provided with the series gap with one end connected to the center electrode side of the spark plug and the other end connected to the high-tension cable extending from the high-voltage distribution side, there is provided a conductive member enclosing the cathode side of the discharge device to be installed in the casing.

4 Claims, 11 Drawing Sheets

DISCHARGE DEVICE AND IGNITION SYSTEM WITH SERIES GAP USING DISCHARGE DEVICE

BACKGROUND OF THE INVENTION

1. Field of the Invention

The present invention relates to a discharge device suitable for use in an ignition system with a series gap for automotive engines, and an ignition system with a series gap using the discharge device.

2. Description of the Prior Art

There is known in the prior art what is called a discharge tube used as a discharge device wherein a pair of electrodes are disposed on opposite sides in a sealed tube and an inactive gas is sealed in the sealed tube.

FIG. 22 shows a discharge tube 1 used in for example an arrester for various kinds of electrical machinery and apparatus. In this discharge tube 1, the open sections at both ends of an insulation tube 2 as a sealed tube formed of ceramics or other are closed with a pair of electrode plates 4, 4 having discharge electrode sections 3, 3 which are disposed opposingly. In the insulation tube 2 is sealed a specific inactive gas. When overvoltage resulting from lighting or other has entered the device, there occurs an electric discharge between the discharge electrode sections 3, 3, momentarily energizing the discharge tube 1 to discharge the overcurrent to the ground side.

Since the discharge tube 1 is placed and connected on a specific electric circuit of an arrester for example, there is arranged an electric element having a specific potential or a metal at a ground potential. If, in this manner, the discharge tube 1 is installed close to an electric element, an electric field formed around the electric element or other will affect the discharge tube 1, resulting in changed discharge voltage characteristics of the discharge tube 1.

There is also known as the prior art (Japanese Patent Publication No. 51-32180) an ignition system C for automotive engines which is provided with a so-called series gap S disposed in series with the spark plug 5 as shown in FIG. 23 in order to prevent the fouling of the spark plug 5 coated with carbon soot, thereby maintaining constant ignition timing. The formation of the series gap S of the discharge tube 1 having the aforementioned constitution is considered.

The ignition system C with series gap as shown in FIG. 24, has the spark-tension cable 6 connected to the high-voltage distribution side. In the plug gap 7 are opposingly disposed a connection terminal 9 designed to fit on a terminal 8 of the spark plug 5 and a high-voltage distribution terminal 10 connected to the end of the high-tension cable 6. And between the terminals 9 and 10 the discharge tube 1 having the discharge electrodes 3, 3 are mounted. The ignition system C of the above constitution is mounted in a recess section 12 formed in an engine cylinder head or a cylinder head cover 11, and attached on the spark plug 5 which is screwed into the cylinder head side. In the drawing, numeral 13 denotes a metal pipe which has the purpose of guiding the ignition system C and also protecting the ignition system C from fouling by engine oil.

However, since the discharge tube 1 is built in the ignition system C and inserted in the cylinder head or the cylinder head cover 11 as described above, the metal pipe 13 which guides the ignition system C is located close thereto. In addition, since the metal pipe 13 is at the same potential as the ground potential of the cylinder head or the cylinder head cover 11, the presence of the metal pipe 13 at this ground potential changes the field strength around the discharge tube 1, resulting in changed discharge voltage characteristics of the discharge tube 1. Such a change in the discharge voltage characteristics is likely to shift the whole ignition timing of the spark plug 5, and accordingly there is the problem that it is impossible to obtain specific automotive engine performance in which the accurate control of the spark plug ignition timing is required to obtain a high engine performance.

SUMMARY OF THE INVENTION

The present invention has been accomplished in an attempt to resolve the problems mentioned above and has an object to provide a discharge device which can be protected from the effect of the electric field of surrounding electric elements or other and an ignition system with series gap capable of improving engine operation performance.

In order to attain the aforementioned object, the discharge device of the present invention, which has a pair of electrodes opposing disposed in a sealed tube, is characterized by providing a conductive member enclosing one of the electrodes in the sealed tube.

The ignition system with series gap of the present invention is an ignition system having a built-in discharge device provided with a series gap, with one end connected to the center electrode side of the spark plug and with the other end connected to the high-tension cable side extending from the high-voltage distribution side. In this ignition system, a discharge device having a conductive member which encloses one of the electrodes of the sealed tube, and one of the electrodes enclosed with the conductive member of this discharge device works as a cathode.

Furthermore, in the ignition system with series gap which includes a discharge tube provided with the series gap with one end connected to the center electrode side of the spark plug and the other end connected to the high-tension cable side extending from the high-voltage distribution side, there is provided a conductive member enclosing the cathode side of the discharge device to be installed in the casing in which the discharge device is to be installed.

According to the discharge device of the present invention, there is provided a conductive member enclosing one of electrodes in the sealed tube and, therefore, when a minus voltage is applied to the electrode around which the conductive member is installed, to discharge electrons from this electrode (cathode), the conductive member works to prevent the effect of the surrounding electric field for the purpose of stabilizing the electric field in the vicinity of the cathode side in the discharge device, thereby enabling stabilizing the discharge voltage characteristics of the discharge device.

Furthermore, according to the ignition system having a series gap of the present invention, a discharge device provided with a conductive member which encloses one of the electrodes of the sealed tube is used as the discharge device installed as the series gap, and one of the electrodes enclosed with the conductive member of the discharge device operates as the cathode. Therefore, when the minus voltage is applied to the discharge member from the high-tension cable, the conductive member can prevent the effect of the surrounding electric field, thereby stabilizing the electric field around the cathode side in the discharge device and getting rid of a change in the discharge voltage characteristics of the discharge device for the purpose of preventing the overall shift of the ignition timing and enhancing engine performance.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1A:
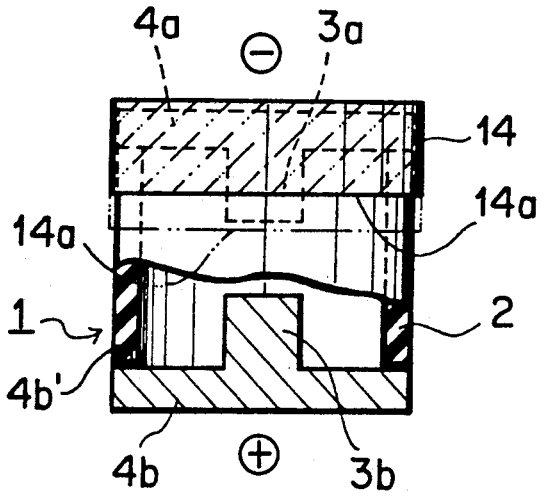
FIGS. 1A and 1B are a partly sectional view and a plan view respectively showing a first embodiment of a discharge tube according to the present invention.

Hereinafter preferred embodiments of the present invention will be explained with reference to FIGS. 1 to 21. The reference numerals are used for the same parts as those used in a prior art.

Figure 1B:
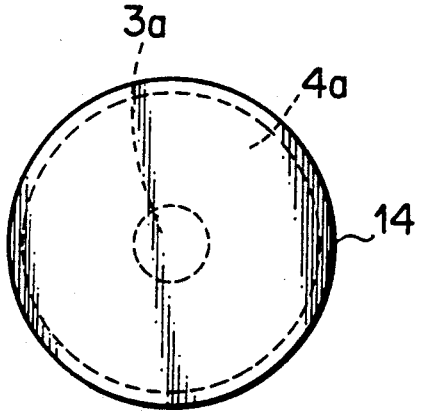

FIGS. 1A and 1B show a first embodiment of a discharge tube 1 used as a discharge device according to the present invention. The hollow cylindrical insulation tube 2 as a sealed tube produced of ceramics is sealed at open sections at both ends with a pair of metal electrode plates 4*a* and 4*b* having the opposing discharge electrodes 3*a* and 3*b*, and in the insulation tube 2 is filled a specific inactive gas, such as argon gas, through a sealing pipe not illustrated. For sealing the inactive gas in the insulation tube 2 of the electrode plates 4, the open ends of the insulation tube 2 are metallized and the jointing section of the insulation tube 2 and the electrode plate 4 are joined by soldering.

On the electrode plate 4*a* of one of the pair of electrode plates 4 described above, a nearly cap-like conductive member 14 used as a back electrode is mounted on the outer periphery of the discharge tube 1 as if to surround the electrode plate 4*a* and a discharge electrode section 3*a* thereof. This conductive member 14 is designed to be electrically connected to the electrode plate 4*a* by a specific means which is not illustrated. The conductive member 14 is produced of for example a metal sheet, and the inner surface of the conductive member 14 and the outer surface of the discharge tube 1 may be either in close contact with or apart from each other with a specific amount of spacing formed therebetween.

In the embodiment, the discharge tube 1 is used so that the high minus voltage is applied to one electrode plate 4*a* side enclosed by the conductive member 14, and that the other electrode plate 4*b* side will be the ground side. Therefore, under the using conditions of the discharge device, the electrode plate 4*a* side operates as a cathode at which electrons are emitted by a discharge phenomenon, while the other electrode plate 4*b* side functions as an anode.

In the embodiment, therefore, the conductive member 14 used around the discharge tube 1 to surround the electrode plate 4*a* on the cathode side and the discharge electrode section 3*a*, and the conductive member 14 and the electrode plate 4*a* are electrically connected; therefore, if the discharge electrode section 3*a* and the conductive member 14 are of the same potential and there is provided an electric element (not illustrated) having a specific potential in the vicinity of the discharge tube 1, forming a specific electric field around the electric element and other, a stabilized electric field can be formed between the discharge electrode section 3*a* and the discharge electrode 3*b* on the opposite side without disturbing the electric field around the cathode side in the discharge tube 1, thereby providing a stabilized discharge phenomenon and also stabilized discharge voltage characteristics between these discharge electrode sections 3*a* and 3*b*. This is clear also from experimental data shown in Table 1.

Figure 22:
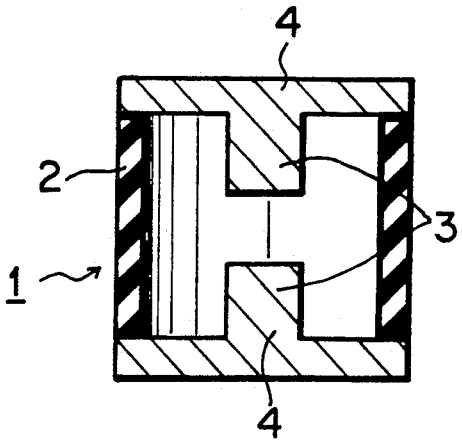
FIG. 22 PRIOR ART
FIG. 22 is a sectional view showing a conventional discharge tube.
Figure 23:
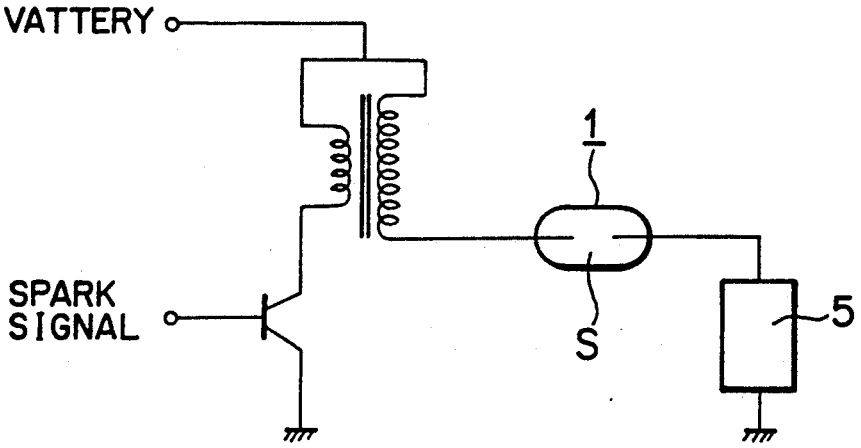
FIG. 23 PRIOR ART
FIG. 23 is a circuit diagram of the ignition system with a series gap.

In the discharge tube which is not provided with a conventional so-called back electrode shown in FIG. 22, the firing potential of 16.5–17.5 kV drops to 14–15 kV when the electric element or other for example at the ground potential approaches, a voltage fluctuation reaching as great as 2 kV. In the case of the first embodiment, however, the firing potential of 10–20 kV varies only to 19.5–20.5 kV when the ground body approaches, the range of this fluctuation therefore being merely 0.5 kV. This is because the use of the conductive member 14 which is at the same potential as the discharge electrode section 3*a* and protects the vicinity of the cathode side in the discharge tube 1 from the effect of the ambient electric field. Thus the fluctuation of the firing potential becomes extremely little, thereby enabling the stabilization of the discharge voltage characteristics.

As is known, the voltage fluctuation can be improved by the ground body within the range that, as shown by an alternate long and two short dashes line in FIG. 1A, the lower end 14*a* of the conductive member 14 installed over the electrode plate 4*a* on the cathode side fully reaches the vicinity of the upper end of the discharge electrode section 3*a* on the cathode side.

Figure 2:
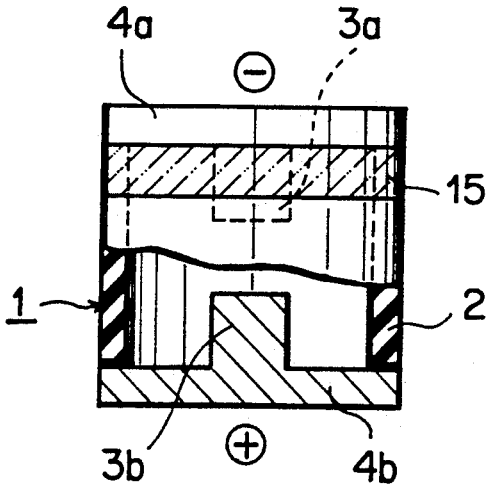
FIG. 2 is a partly sectional view showing a second embodiment of the discharge tube.

FIG. 2 shows a second embodiment of the discharge tube 1 according to the present invention, wherein a metallized band 15 of specific width is formed on the outer peripheral surface of one open end of the insulation tube 2 at the time of metallizing the open end of the insulation tube 2. With both open end sections of the insulation tube 2 having the metallized band 15 sealed with a pair of electrode plates 4*a* and 4*b* having the discharge electrode sections 3*a* and 3*b*, one electrode plate 4*a* is electrically connected to the metallized band 15, and also the discharge electrode section 3*a* is positioned within the metallized band 15, such that the metallized band 15 may surround the electrode section 3*a* and function as a conductive member which serves as what is called the back electrode. And, similarly to the first embodiment, the discharge tube 1 is used so that the electrode plate 4*a* provided on the side the metallized band 15 is formed will be on the cathode side.

Therefore, in this embodiment also, it is possible to prevent the effect of a surrounding electric field and to form the conductive member simultaneously with metallizing, thereby reducing the number of processes and a manufacturing cost.

Figure 3:
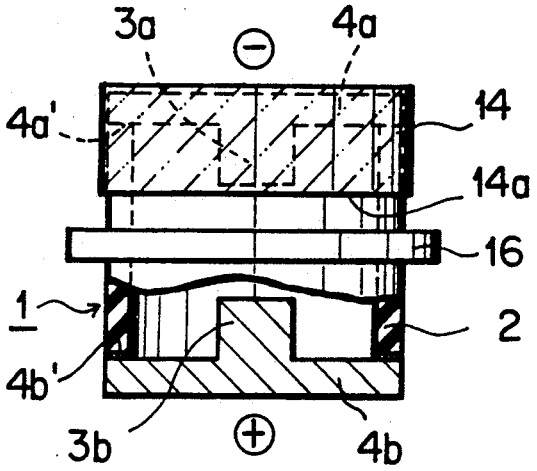
FIGS. 3 and 4 are partly sectional views showing a third and a fourth embodiment respectively for the prevention of surface discharge.

By the way, when the conductive member electrically connected to the electrode plate 4*a* on the cathode side is provided around the discharge tube 1 to surround the electrode plate 4*a* and the discharge electrode section 3*a* in order to prevent the effect of the ambient electric field, the insulation distance from the lower end 14*a* of the conductive member to the end face 4*b*' of the electrode plate 4*b* on the anode side to be joined to the insulated tube 2 decreases as shown in FIG. 3, and accordingly it is likely that there occurs a so-called surface discharge along the outside wall surface of the insulation tube 2 across this insulation distance.

Figure 4:
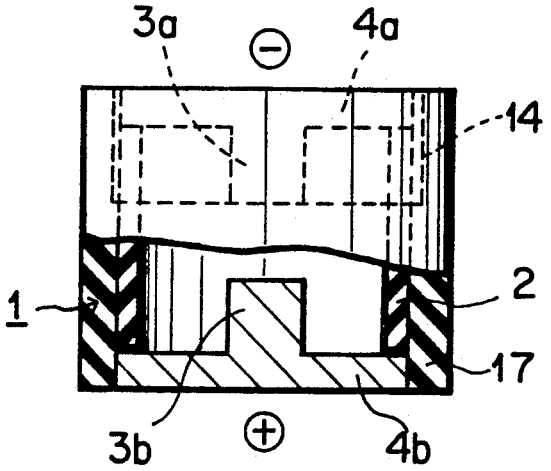

In order to prevent such a surface discharge, as described in a third embodiment shown in FIG. 3, a better result can be obtained by forming a collar section 16 on the outside wall surface of the insulation tube 2 between the lower end 14*a* of the conductive member and the joining end face 4*b*' of the anode side electrode plate, and by producing the surroundings of the discharge tube 1 from an electric insulating material 17 by moulding as stated in a fourth embodiment shown in FIG. 4.

Forming the collar section 16 as described above makes substantially longer the tube (insulation distance) along the outer surface of the insulation tube 2 from the joining end face 4*a*' joining the cathode-side electrode plate 4*a* to the insulation tube 2 to the joining end face 4*b*' of the anode-side electrode plate, making it difficult to produce the surface discharge. Also, moulding the electrically insulating material 17 dispenses with a part, such as an air stratum on the outside surface of the insulation tube 2, which induces the surface discharge, thus enabling the prevention of the surface discharge.

Also, as shown in FIGS. 5 to 8, it is conceivable to form an extremely short discharge electrode section 3*a* on the cathode side in order to increase the length of the discharge electrode section 3*a* and the anode-side discharge electrode section 3*b* which has a specific discharge gap, by an amount equal to the decreased amount of the cathode-side discharge electrode section 3*a*, thereby decreasing the length of the conductive member as the so-called back electrode disposed on the cathode side and accordingly increasing the insulation distance.

Figure 5:
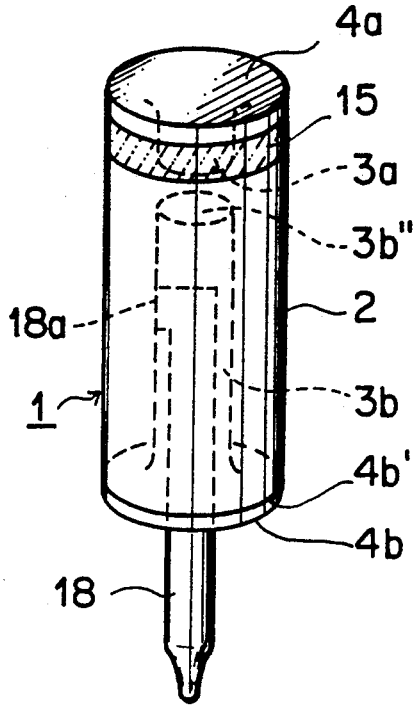
FIGS. 5 to 8 are perspective views showing another embodiment for the prevention of surface discharge.

Namely, as described in a fifth embodiment shown in FIG. 5, the discharge electrode 3*a* on the cathode side is formed extremely short and at the same time the discharge electrode section 3*b* on the anode side is increased in length by an amount equal to the decreased amount of the discharge electrode 3*a*. Also, there is formed for example a metallized band 15 extremely short but wide just enough to surround the short discharge electrode section 3*a*, in order that the metallized band 15 and the electrode plate 4*a* having the discharge electrode section 3*a* thus formed are electrically connected.

As is clear from data shown in Table 1 which is given later on, after the above-mentioned increase in the insulation distance, the firing potential of 16.5–17.5 kV before the approach of the ground body makes no change even when the ground body approaches, accordingly is entirely free from the effect of the ambient electric field. In addition, as the insulation distance from the lower end 15*a* of the metallized band 15 to the joining end face 4*b*' of the anode-side electrode plate 4*b* which is jointed to the insulation tube 2 can be fully extended, thereby enabling the prevention of occurrence of the surface discharge.

Generally, in the discharge tube 1, the inactive gas is filled and a gas filling pipe is attached to one of the electrode plates 4 for sealing the open end sections of the insulation tube 2 comprising the discharge tube 1. This gas filling pipe is coaxially extending into the discharge electrode section 3 of the electrode plate 4 on which the gas filling pipe is attached, with a pipe end being open into the insulation tube 2. In this embodiment, however, since the discharge electrode section 3*b* is formed extremely long on the anode side, the provision of the gas filling pipe 18 on the discharge electrode section 3*b* side can open a pipe end 18*a*, which is formed by bending the forward end portion of the gas filling pipe, to the peripheral surface of the discharge electrode section 3*b*. According to this design, the gas filling pipe 18 does not pass through to the discharge face 3*b*'' at the top end of the discharge electrode 3*b*, and therefore the discharge face 3*b*' at the top end of the discharge electrode 3*b* can be increased in surface area, thereby diminishing the influence of electrode consumption for the purpose of prolonging the life of the discharge tube 1.

Figure 6:
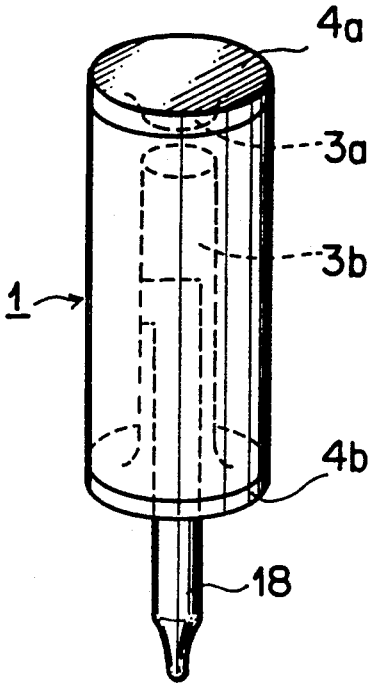

A sixth embodiment shown in FIG. 6 sets forth the cathode-side discharge electrode 3*a* of the fifth embodiment which is further decreased in length, so that the discharge electrode 3*a* does almost or completely not project out of the cathode-side electrode plate 4*a*. Thus, the electrode plate 4*a* works as a conductive member which functions as a back electrode described above, displaying an effect approximately similar to that of the back electrode particularly even when no back electrode is provided. As no back electrode is in use, it is possible to lower the cost of the whole body of the discharge tube 1 and also to prevent the surface discharge described above.

Figure 7:
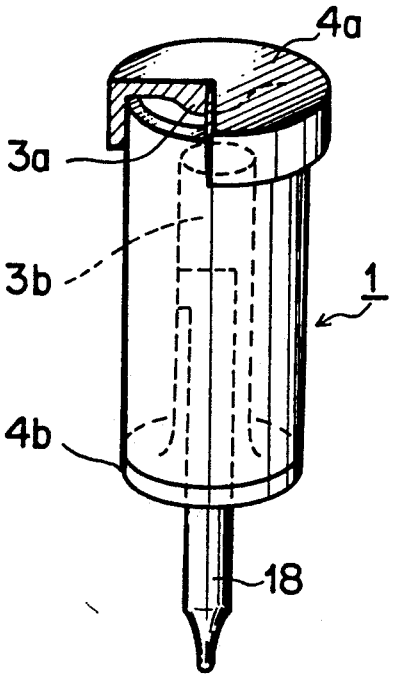
Figure 8:
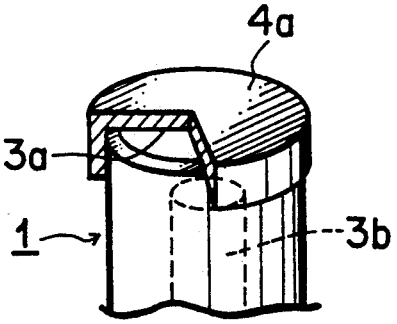

In the seventh embodiment shown in FIG. 7, the cathode side electrode plate 4*a* which acts as the above-mentioned back electrode may be made substantially in the form of a cap having a slight protuberance formed in its inner surface thereof to act as discharge electrode section 3a. The eighth embodiment shown in FIG. 8, the discharge electrode is not in the protruding form, even in which case an approximately similar result to the back electrode is obtained and the surface discharge is prevented from being generated.

It has been found, as a result of various tests of the discharge tube 1 having the conductive member 14 used as what is called a back electrode which covers the electrode plate 4a on the cathode side and the discharge electrode section 3a as shown in the first embodiment, that it is sufficient only to protect the lower end section of the cathode-side discharge electrode section 3a from which the electrons are emitted, from the effect of the ambient electric field, and therefore it is unnecessary to surround the whole body of the discharge electrode section 3a with the conductive member 14. Hereinafter, an explanation will be made of the discharge tube of such a construction that the lower end section of the cathode-side discharge electrode section 3a will not be affected by the ambient electric field.

Figure 9:
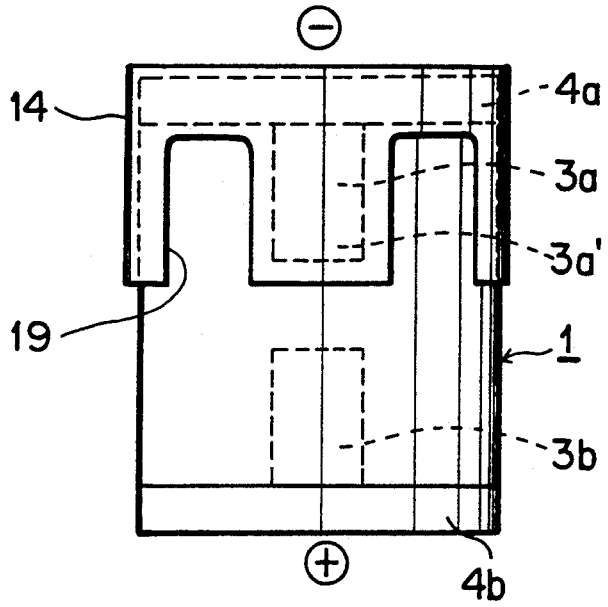
FIG. 9 is a side view showing a ninth embodiment of the discharge tube.

FIG. 9 shows a ninth embodiment of the discharge tube 1 according to the present invention, wherein the conductive member 14 used as the back electrode is provided with a plurality of cutouts 19 within the range that the lower end section 3a' of the discharge electrode 3a on the cathode side will never be affected by an ambient electric field.

According to the present invention, it is possible to stabilize the discharge voltage characteristics between the discharge electrode sections 3a and 3b without disturbing the vicinity of the cathode side in the discharge tube 1 by the ambient electric field. Furthermore, as it is unnecessary to use the conductive member in the area the cutout section 19 is formed, it is possible to decrease materials and accordingly to reduce the manufacturing cost.

Figure 10:
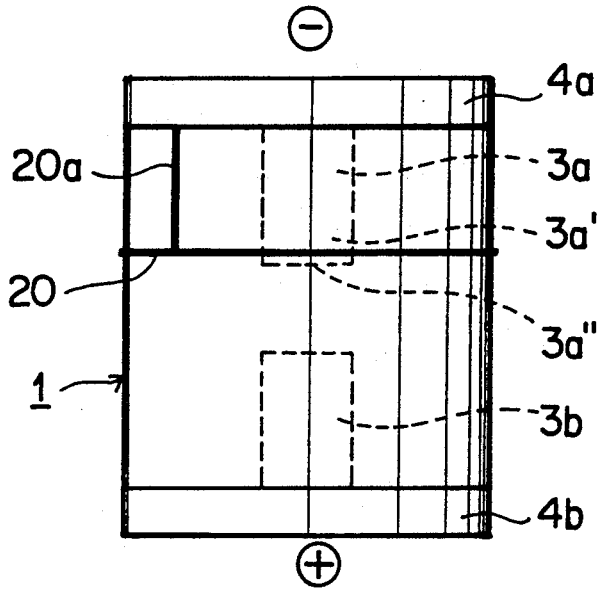
FIG. 10 is a side view showing a tenth embodiment of the discharge tube.
Figure 11:
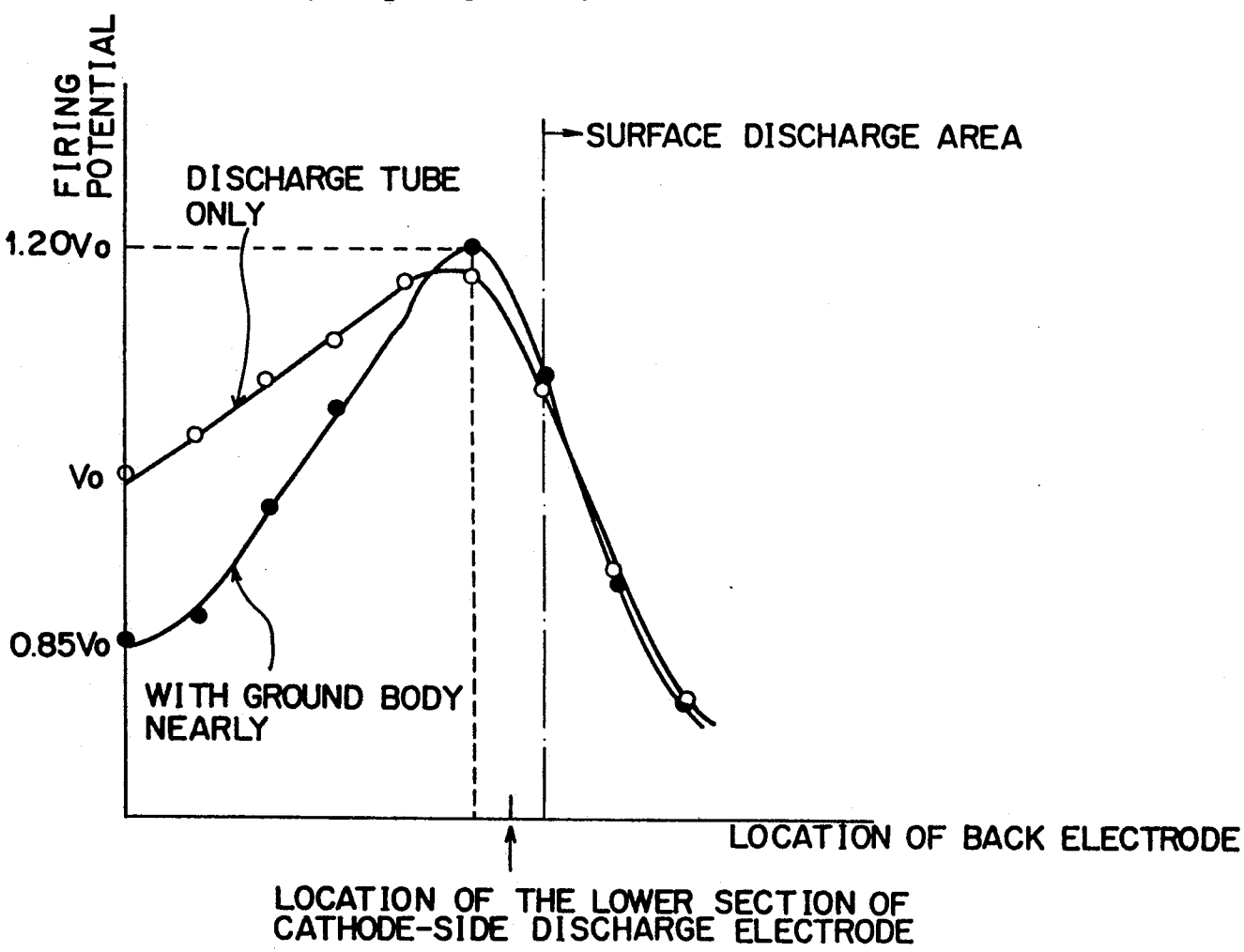
FIG. 11 is a view showing a relationship between the firing potential and the position of a back electrode according to the tenth embodiment.
Figure 12:
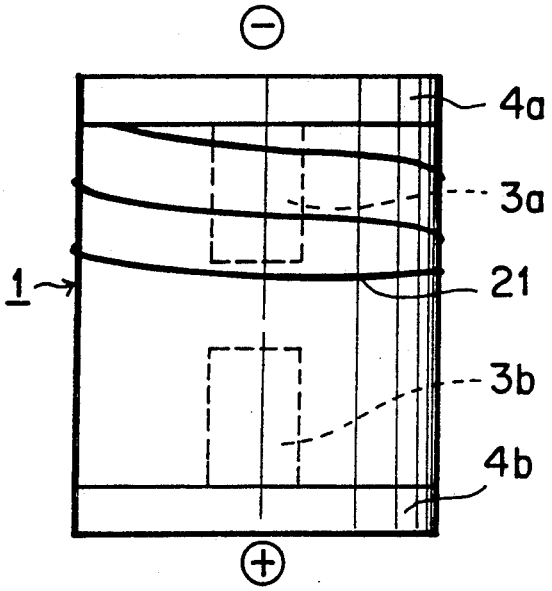
FIG. 12 is a side view showing an eleventh embodiment of the discharge tube.

FIG. 10 shows a tenth embodiment of the discharge tube 1 according to the present invention, wherein continuous one turn of a metal wire 20 is electrically connected to the electrode plate 4a through a lead section 20a on the outer peripheral surface of the insulation tube 2 in a position slightly closer to the electrode plate 4a from the lower end 3a'' of the cathode-side discharge electrode section 3a.

In this embodiment, the metal wire 20 functions as the conductive member used as what is called the back electrode, thus preventing the effect of the ambient electric field. Even when the ground boy is located nearly the firing potential of 20–20.5 kV varies only to 19–19.5 kV as shown in Table 1 given later on, its discharge voltage characteristics remaining stabilized. As the back electrode is composed merely of the metal wire 20, the discharge device can be produced at an extremely low cost.

This metal wire 20 should be installed slightly closer to the electrode plate 4a side than to the lower end 3a'' of the cathode-side discharge electrode section 3a. In this position the highest firing potential and the maximum effect thereof are obtainable as is clear from the relationship between the firing potential and the location of the metal wire shown in FIG. 11. The metal wire 20 may be a discontinued one turn of metal wire having a plurality of discontinuities within the range that the lower end section 3a' of the cathode-side discharge electrode 3a will not be affected by the ambient electric field, or may have a plurality of turns of metal wire. Furthermore, as an eleventh embodiment shown in FIG. 12, a metal wire 21 whose one end is connected to the cathode-side electrode plate 4a may be wound into a form of coil spring on the outer peripheral surface of the insulation tube 2.

It has been made clear by further researches of the present inventor et al that the discharge voltage characteristics of the discharge tube can be stabilized if the conductive member 14, the metallized band 15, or the metal wire 20, 21 which is used as what is called the back electrode shown in the embodiments 1 to 11 is not electrically connected with the electrode plate 4a on the cathode side. Hereinafter, therefore, the discharge tube whose back electrode has no electrical connection with the electrode plate 4a on the cathode side will be explained.

Figure 13:
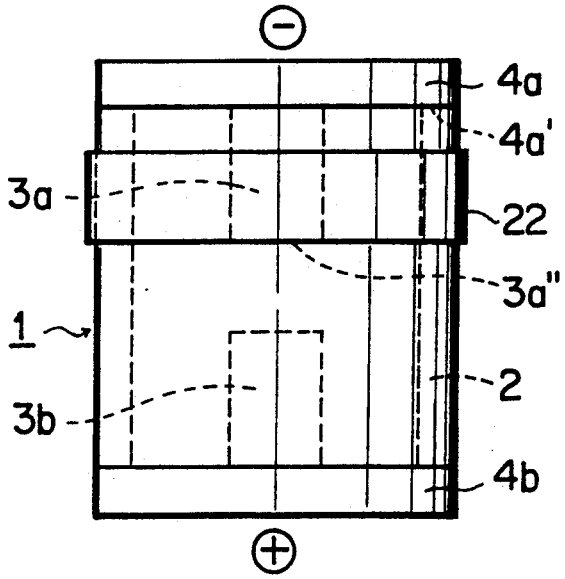
FIG. 13 is a side view showing a twelfth embodiment of the discharge tube.

FIG. 13 shows a twelfth embodiment of the discharge tube 1 according to the present invention. On the outer peripheral section of the discharge tube 1 is provided a band-like conductive member 22 which surround the discharge electrode section 3a, extending from a position 1 to 2 mm apart from the joining end 4a' of the cathode-side electrode plate 4a which is joined to the insulation tube 2, to the lower end 3a'' of the discharge electrode section.

In the discharge tube of such a constitution, the conductive member 22 functions as the so-called back electrode to shut off the effect of the ambient electric field, fully displaying its effect particularly when the high minus voltage is applied to the cathode side of the discharge tube 1 (when the spacing is several millimeters or larger, the conductive member 22 can still show an effect as the back electrode though not fully). There occurs, therefore, no disturbance by the conductive member 22 in the vicinity of the cathode side in the discharge tube 1, thereby enabling the stabilization of the discharge voltage characteristics between the discharge electrode sections 3a and 3b. In addition, as no work is needed for electrical connection between the conductive member 22 and the cathode-side electrode plate 4a, the manufacturing cost can be lowered further.

Figure 14:
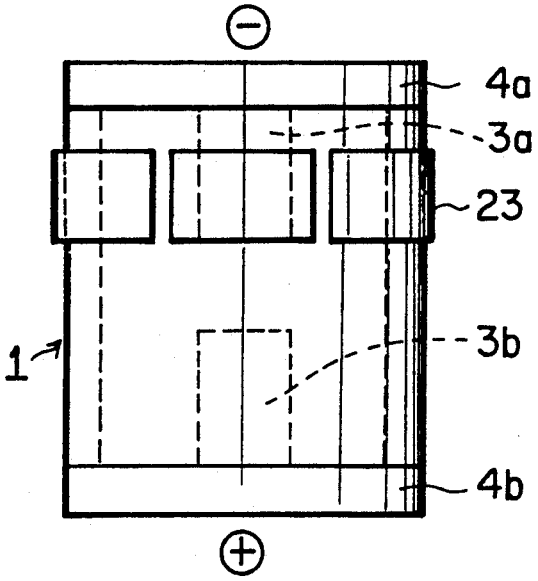
FIG. 14 is a side view showing a thirteenth embodiment of the discharge tube.
Figure 15:
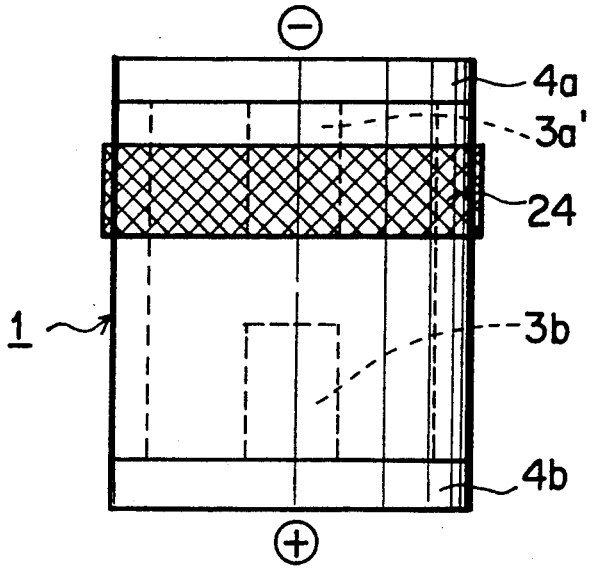
FIG. 15 is a side view showing a fourteenth embodiment of the discharge tube.
Figure 16:
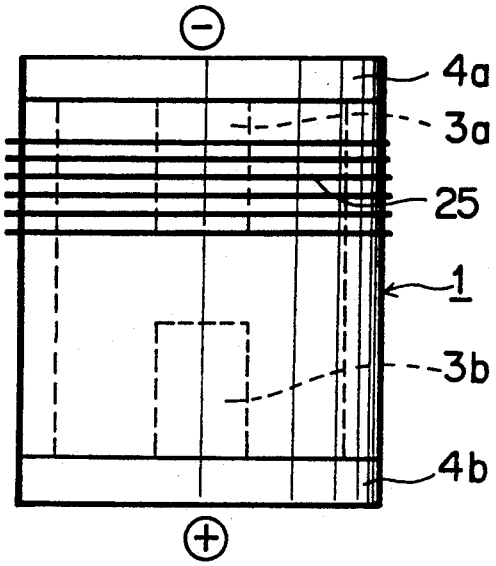
FIG. 16 is a side view showing a fifteenth embodiment of the discharge tube.
Figure 17:
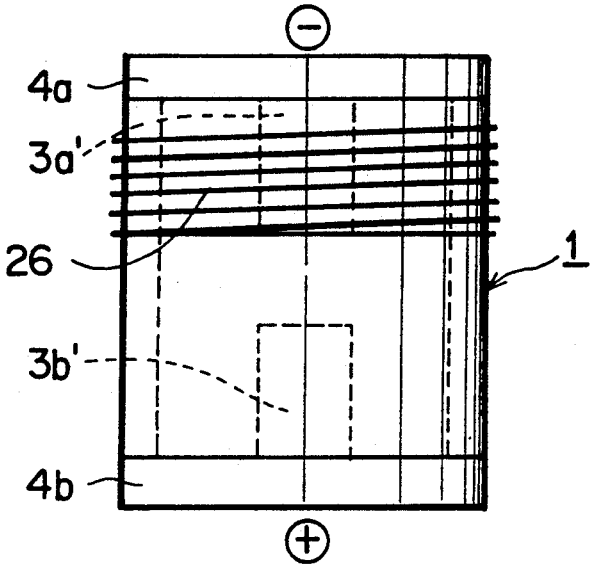
FIG. 17 is a side view showing a sixteenth embodiment of the discharge tube.

The conductive member described above may be either a conductive member 23 which is not continuous with a plurality of discontinuities as set forth in a thirteenth embodiment shown in FIG. 14 or a mesh-like conductive member 24 described in a fourteenth embodiment shown in FIG. 15. Furthermore, it is possible to provide a set of metal rings 25 put in a plurality of layers or a metal wire 26 in a form of coil spring, as described in fifteenth and sixteenth embodiments shown in FIGS. 16 and 17 respectively.

Each of the conductive members described above in the first to sixteenth embodiments can be formed by varied processes, besides the above-mentioned, such as metal foiling, metallizing, conductive painting, evaporation coating, sputtering, etc. The location of the conductive member is not limited to the outer peripheral section of the discharge tube 1, but may be the inner peripheral section of the discharge tube 1. However, the installation of the conductive member on the inner periphery of the discharge tube 1 is likely to cause the surface discharge to occur inside of the discharge tube; it is, therefore, necessary to adopt some effective means for prevention of the surface discharge. Furthermore, the conductive member may be embedded in a specific location in the wall of the insulation tube 2 at the stage of manufacture, not installed on the outer or inner periphery of the discharge tube 1.

Furthermore, it should be noted that the discharge tube 1 is given as one example of the discharge device with a pair of electrodes disposed opposingly with a specific discharge gap provided therebetween and sealed in a sealed tube, and with an inactive gas filled in this sealed tube, and that the discharge device of the present invention is not limited only to the discharge tube 1.

Table 1 given below shows, as a test data which shows the effect of the aforementioned conductive member, the values of firing potential of the discharge tube body of each of the embodiments, and the values of firing potential obtained when the ground body approaches, in comparison with conventional examples shown in FIG. 22.

TABLE 1

(Unit: kV)

| | Discharge tube body alone | When ground body approaches |
|---|---|---|
| Conventional example | 16.5 to 17.5 | 14 to 15 |
| FIG. 1 | 19 to 20 | 19.5 to 20.5 |
| FIG. 5 | 16.5 to 17.5 | 16.5 to 17.5 |
| FIG. 10 | 20 to 20.5 | 19 to 19.5 |
| FIG. 13 | 19.5 to 20.5 | 19 to 20 |
| FIG. 14 | 19 to 20 | 19 to 20 |
| FIG. 15 | 18.5 to 20 | 20 to 20.5 |

Figure 18:
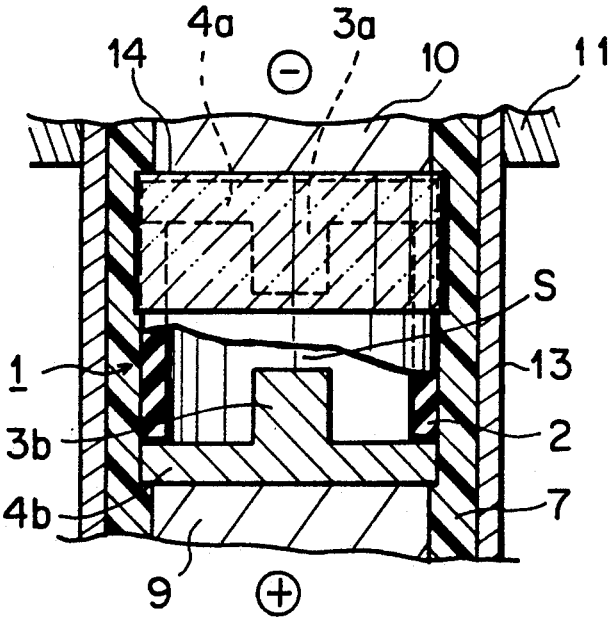
FIG. 18 is a sectional view showing a major portion of the first embodiment of an ignition system with a series gap according to the present invention.
Figure 20:
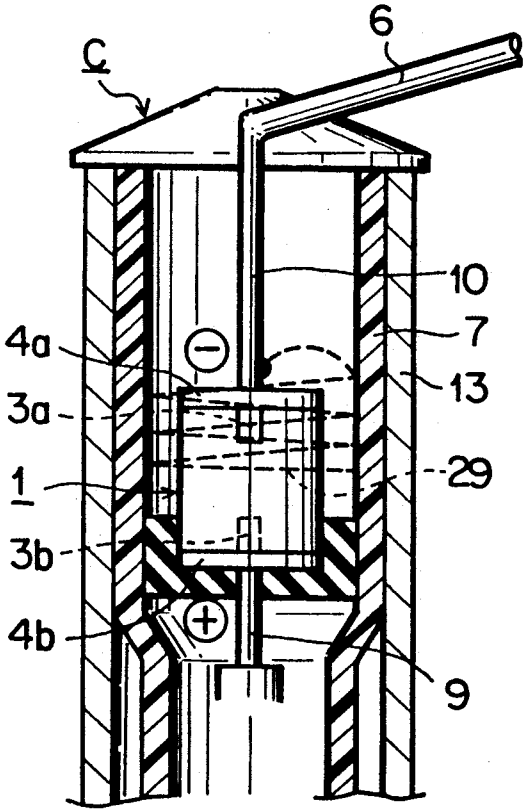
FIG. 20 is a sectional view showing a third embodiment of the ignition system with the series gap.

FIG. 18 shows a first embodiment of the ignition system C with series gap which uses the discharge device 1 according to the present invention, wherein, in the plug cap 7 embedded in the metal pipe connected to the cylinder head or the cylinder head cover 11, there is installed the discharge tube 1 having the cap-shaped conductive member 14 as a back electrode which covers one electrode side 4*a*, 3*a* shown in FIG. 1A. In addition, this discharge tube 1 is installed in such a manner that its one end provided with the conductive member 14 is connected to the high-tension cable side extending from the high-tension coil which produces the minus voltage, while the other end having no conductive member 14 is connected to the center electrode side of the spark plug.

Therefore, in this embodiment, the discharge device is adapted to be used such that one electrode side 4*a*, 3*a* of the discharge tube 1 will work as a cathode from which the electrons are emitted in the discharge phenomenon and the other electrode side 4*b*, 3*b* will work as the anode.

In this embodiment, the discharge tube 1 functions as the series gap S provided in series with the spark plug, and the discharge voltage present across this series gap is maintained at a high value to a certain degree. At the same time, the voltage present in this series gap after discharge is applied to the spark plug all at once, thereby obtaining an ignition voltage necessary for the spark plug without being affected by a short circuit caused by carbon deposits on the spark plug.

Particularly because the discharge tube 1 is used so that the cathode side 4*a*, 3*a* which emits the electrons in the discharge phenomenon may be covered with the conductive member 14, the discharge tube 1 will become free from a change in the electric field strength caused by the metal pipe 13 which is at ground potential, thereby enabling discharge stabilization. Thus it is possible to stabilize the discharge voltage characteristics of the discharge tube 1 by this stabilized discharge, prevent the overall shift of the ignition timing, and improve engine operation performance.

Figure 19:
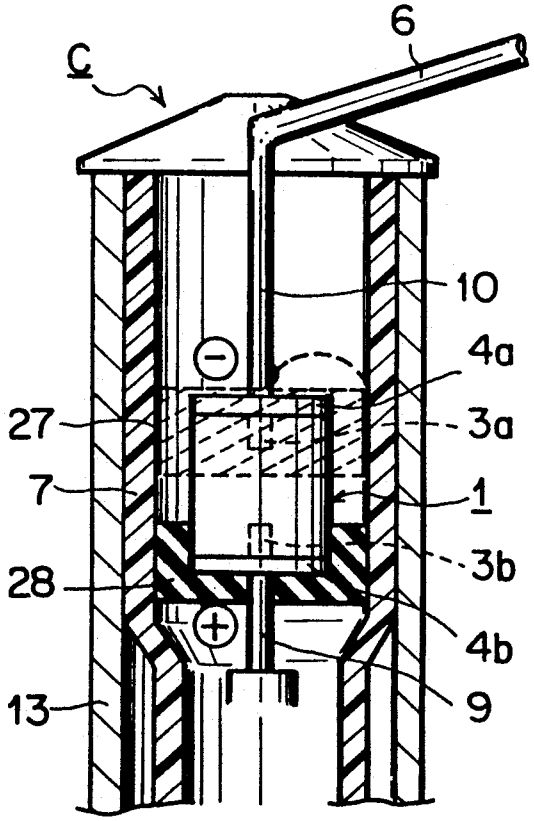
FIG. 19 is a sectional view showing a second embodiment of the ignition system with the series gap.

FIG. 19 shows a second embodiment of the ignition system C with a series gap according to the present invention. In this second embodiment, as in the case of the first embodiment described above, the discharge tube 1 having the conductive member is not used, but the conductive member as the back electrode is mounted on the plug cap 7 side and the discharge tube 1 of prior art shown in FIG. 22 is employed.

On the inner peripheral surface of the plug cap 7 is installed a band-like conductive member 27 on the high-voltage distribution terminal 10 side connected to the high-tension cable 6 extending from the high-tension coil which produces the minus voltage such that the conductive member 27 covers one electrode section 4*a*, 3*a* of the discharge tube 1 installed inside of the plug cap 7. This conductive member 27 is connected by a wire to the high-voltage distribution terminal 10 in order to maintain the same potential as the high-voltage distribution terminal 10 side.

Therefore, in the plug cap 7, high-voltage terminal 10 side to which the minus voltage is applied is the cathode, and the connection terminal 9 connected to the center electrode of the spark plug is the anode. When the discharge tube 1 is mounted in the plug cap 7, one electrode section 4*a*, 3*a* of the discharge tube 1 which is connected with the high-voltage distribution terminal 10 and functions as the cathode becomes of the same potential as the conductive member 27; even when there is formed the prescribed electric field around the discharge tube 1, the vicinity of the cathode side in the discharge tube 1 will not be disturbed. At the discharge electrode section 3*a* is formed a stabilized electric field between the opposing discharge electrode sections 3*b*. Therefore, the discharge tube 1 is not affected by any change in the electric field strength caused by the metal pipe 13 at the ground potential which guides and protects the plug cap 7, and it is possible to prevent the overall shift of the ignition timing by stabilizing the discharge voltage characteristics, thereby improving the engine operation performance.

In the drawing, numeral 28 denotes an electrical insulating moulded material of plastics or other for holding and fixing the discharge tube 1 within the plug cap 7. The conductive member 27, as described above, must not be serial one but may have a plurality of discontinuities. Also, as stated in the third embodiment shown in FIG. 20, the coil spring-shaped metal wire 29 may be used. Furthermore, the effect of an ambient electric field can be fully prevented if the conductive member 27 is not electrically connected with the high-voltage terminal 10, and the conductive member 27 may be formed of various kinds of materials such as metal foil, metal mesh, conductive paint, etc.

Figure 21:
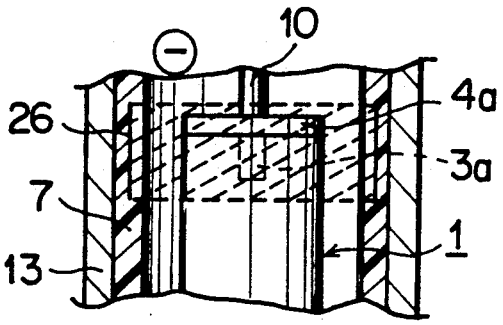
FIG. 21 is a sectional view showing a major portion of a fourth embodiment of the ignition system with the series gap.

Furthermore, as shown in the fourth embodiment of FIG. 21, a similar effect can be obtained by the use of the conductive member embedded in the wall of the plug cap 7.

All of the high-tension coils provided in the circuit of the ignition system with a series gap produce minus high-voltage pulses, obtaining a remarkable effect of the conductive member used as a back electrode. In the circuit described above, however, the effect of the back electrode can not be obtained if the high-tension coil produces plus high-voltage pulses. Even in this case, there will arise no problem in particular.

In the above-described circuit, when the high-tension coil produces the plus high-voltage pulses and the discharge device is connected on the side provided with no back electrode to the high-tension cable side, this side works as the anode. Also, the side having the back electrode, when connected to the center electrode of the spark plug, functions as the cathode. In this case, as previously stated in the first to fourth embodiments, the remarkable effect obtainable when the minus high voltage is applied to the back electrode cannot be gained but a certain degree of the same effect is obtainable, thereby stabilizing discharge voltage characteristics to some extent.

In the ignition system with a series gap described above, the discharge device functioning as the series gap has been explained separately from the spark plug. The present invention, however, should not be limited to the aforementioned embodiments; the discharge device used as the series gap may be such a device formed integral with the plug built in the spark plug.

Figure 24:
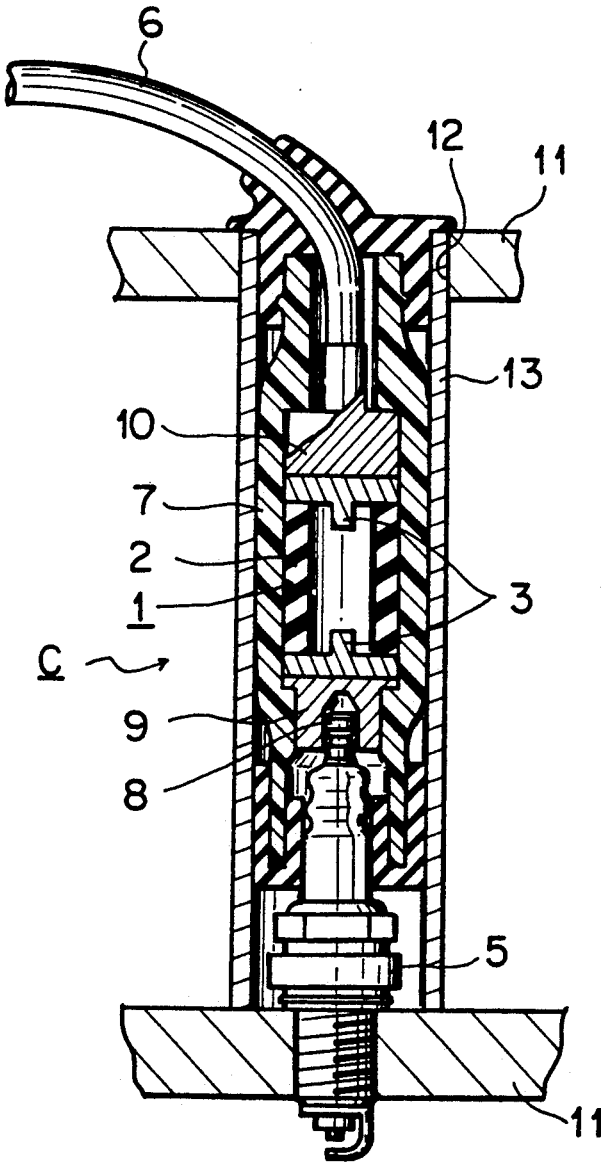
FIG. 24 is a sectional view showing a conventional ignition system with a series gap.

Table 2 gives a test data showing the effect of the ignition system C with a series gap having the conductive member, comparing a conventional example shown in FIG. 24 with the values of the firing potential of the assembly body with the discharge member 27 of the second embodiment both electrically connected and not electrically connected to the cathode side of the discharge tube 1, and the values of the firing potential with the ground body having approached them.

TABLE 2

(Unit: kV)

| | Assembly body alone | Ground body approaches |
|---|---|---|
| Conventional example | 16.5 to 17.5 | 14.5 to 15.5 |
| Conductive member is connected to discharge tube | 18.6 to 19.5 | 18.5 to 19.5 |
| Conductive member is not connected to discharge tube | 18 to 19 | 18 to 19 |

In this discharge device according to the present invention described above, since the conductive member is provided to substantially surround one of the electrodes of the sealed tube, the conductive member shuts off the effect of the ambient electric field to stabilize the electric field in the discharge device when the electrons are emitted from the cathode provided with the conductive member applied with the minus voltage, thus stabilizing the discharge voltage characteristics of the discharge device.

The ignition system with a series gap according to the present invention uses a discharge device having the conductive member which substantially surround one of the electrodes of the sealed tube, for a discharge device installed as a series gap in the engine cylinder, such that one of the electrons enclosed by conductive member will be a cathode. When the minus voltage is applied from the high-tension cable side to the discharge device, the conductive member prevents the effect of the surrounding electric field in order to stabilize the electric field around the cathode side in the discharge device without a change in the discharge voltage characteristics of the discharge device, thereby preventing the overall shift of the ignition timing and accordingly further enhancing the engine performance. Furthermore, since the conductive member substantially surround the cathode section of the discharge device is installed in the casing in which the discharge device is to be installed as a series gap, the conductive member prevents the effect of the surrounding electric field and stabilize the electric field in the vicinity of the cathode side in the discharge device without affecting the discharge voltage characteristics of the discharge device, thereby preventing the overall shift of the ignition timing and further improving the engine performance.

While only certain embodiments of the present invention have been described, it will be apparent to those skilled in the art that various changes and modifications may be made therein without departing from the spirit and scope of the present invention as claimed.

What is claimed is:

1. A discharge device comprising:

a cathode electrode;

an anode electrode;

wherein said cathode electrode and said anode electrode are facing each other with a gap therebetween, said discharge device further comprising back electrodes, each provided at a back side of said cathode electrode and said anode electrode, and electrically insulated from each other by a non-conductive tubular support member;

an additional back electrode surrounding said non-conductive tubular support member only at parts thereof substantially corresponding to a location of said cathode electrode so as to make the device free from effects of an ambient electric field and to prevent electric discharge from occurring surfacially on the discharge device by securing dimensions of the nonconductive tubular support member as large as possible, and said additional back electrode is electrically connected to said back electrode of said cathode electrode and electrically disconnected from a ground potential.

2. A discharge device having a cathode electrode and an anode electrode facing each other with a gap therebetween, and means for eliminating the effects of ambient electric fields and for preventing electric discharge along a surface of the discharge device, said means being coupled to said cathode and said anode electrodes;

wherein said means includes a non-conductive tubular support member which supports said anode and cathode, and a back electrode on an outer surface of said non conductive tubular support member, and said back electrode cooperatively surrounds said non-conductive tubular support member such that effects of an ambient electric field are eliminated, and surface electric discharge is prevented.

3. A discharge device according to claim 2, wherein said back electrode is electrically connected to said cathode.

4. A discharge device according to claim 2, wherein said back electrode is insulated from a ground potential.

* * * * *